US005473357A

United States Patent [19]

Shirakawa et al.

[11] Patent Number: 5,473,357

[45] Date of Patent: Dec. 5, 1995

[54] THERMAL HEAD AND MANUFACTURING METHOD

[75] Inventors: Takashi Shirakawa, Takizawa; Toshifumi Nakatani, Morioka, both of Japan

[73] Assignee: Alps Electric Co., Ltd., Tokyo, Japan

[21] Appl. No.: 140,352

[22] Filed: Oct. 20, 1993

[30] Foreign Application Priority Data

Oct. 21, 1992 [JP] Japan ..... 4-307704

[51] Int. Cl.[6] ..... B41J 2/335

[52] U.S. Cl. ..... 347/202

[58] Field of Search ..... 346/76 PH; 347/202

[56] References Cited

U.S. PATENT DOCUMENTS 4,768,038 8/1988 Shibata ..... 346/76 PH
4,795,887 1/1989 Myokan ..... 346/76 PH
4,802,080 1/1989 Bossi et al. .
4,907,015 3/1990 Kaneko et al. ..... 346/76 PH
5,099,257 3/1992 Nakazawa et al. ..... 346/76 PH
5,156,896 10/1992 Katoh et al. ..... 346/76 PH
5,162,814 11/1992 Shirakawa et al. ..... 346/76 PH
5,182,574 1/1993 Kato et al. ..... 346/76 PH

*Primary Examiner*—Huan H. Tran
*Attorney, Agent, or Firm*—Guy W. Shoup; Patrick T. Bever

[57] ABSTRACT

A thermal head having high heat resisting characteristics and heat response capable of being sufficiently adapted for finer printing and achieving high quality printing at a high speed, the substrate thereof being formed of silicon and the heat accumulation layer thereof being formed of silicon, at least one selected among from elements such as Ta, W, and Mo and oxygen.

4 Claims, 3 Drawing Sheets

THERMAL HEAD AND MANUFACTURING METHOD

BACKGROUND OF THE INVENTION

1. Field of the Invention

The present invention relates to a thermal head and a method for manufacturing it and, more particularly, to a thermal head suitable for high speed printing which has high heat resisting characteristics and good thermal response and a method for manufacturing the same.

2. Prior Art

Thermal heads incorporated in thermal printers are generally used for recording, for example, by linearly arranging a plurality of heating resistors on a same substrate and by energizing and heating the heating resistors in accordance with desired printing information to cause a thermosensible recording paper to develop a color or by transferring ink onto a plain paper through an ink ribbon.

FIG. 5 shows a conventional thermal head wherein a glazed layer 2 made of glass or the like acting as a heat accumulating layer is formed on an insulating substrate 1 made of ceramics such as alumina. The glazed layer 2 is formed so that its upper surface will have a circular section. A plurality of heating resistors 3 made of $Ta_2N$ (tantalum nitride) or the like are coated on the upper surface of the glazed layer 2 through vapor deposition, sputtering or the like, etched, and linearly aligned in accordance with the number of dots. On one side of each heating resistors 3, a common electrode 4 which is connected to each heating element 3 is formed. On the other side, an individual electrode 5 for individually energizing respective heating resistors 3 is connected. The common electrode 4 and the individual electrode 5 are made of aluminum, copper, gold or the like. for example, and are formed by coating through vapor deposition, sputtering or the like and by patterning into desired shapes through etching.

Further, on the surfaces of the heating resistors 3, common electrodes 4 and individual electrodes 5, a protective layer 6 having a thickness of approximately 5 to 10 μm is formed to protect the heating resistors 3, common electrodes 4 and individual electrodes 5. The protective layer 6 is formed so that it covers the entire surfaces except terminal portions of the electrodes 4 and 5. The protective layer 6 has a construction wherein an oxidation resistant layer 7 made of $SiO_2$ or the like having a thickness of approximately 2 μm for protecting the heating resistors 3 against deterioration due to oxidation and an abrasion resistant layer 8 made of $Ta_2O_5$ or the like having a thickness of approximately 3 to 8 μm for protecting the heating resistors 3 and electrodes 4 and 5 against abrasion caused by contact with an ink ribbon or a thermosensible paper are laminated in this order. The oxidation resistant layer 7 and the abrasion resistant layer 8 are sequentially formed by means of vapor deposition, sputtering or the like.

In a thermal printer utilizing such a thermal head, printing is carried out as desired by selectively energizing the individual electrodes 5 of the heating resistors 3 in accordance with a predetermined printing signal, with the thermal head pressed into contact with a paper transported onto a platen through an ink ribbon or directly in the case of a thermosensible recording paper, to cause desired heating resistors to generate heat, thereby fusing ink on the ink ribbon and transferring it onto the paper or causing the thermosensible recording paper to develop a color.

In such a thermal head, balance is maintained between power efficiency and printing characteristics making use of heat accumulating effect of Joule heat generated by the heating resistors 3 through the combination of the glazed layer 2 of low heat conductivity ($2\times10^{-3}$ cal/cm.Sec.°C.) and the insulating substrate 1 of comparatively high heat conductivity ($40\times10^{-3}$ cal/cm.Sec.°C.) made of alumina. Specifically, time constant of cooling of the heat resistors 3 becomes long due to the heat accumulating effect of the glazed layer 2. As a result, there will be deterioration of printing quality such as, smears and blurs on printed letters and stains in blank spaces and missing dots due to overheat of the heating resistors during high speed printing. Therefore, the thickness of the glazed layer 2 is adjusted in accordance with operating conditions taking both power efficiency and printing characteristics into consideration and is normally on the order of 30 to 60 μm.

Increased demands for printers capable of high quality printing with finer printing characteristics at high speeds in recent years has resulted in the introduction of thermal printers having printing resolution of 400 dpi (dot per inch) and a printing speed of 100 cps (character per second) into practical use. In such a thermal printer, energization is controlled with a very small pulse width such that the driving cycle of the heating resistors 3 will be 300 μs or shorter. There is a continuing trend toward finer and faster printing.

Since accumulation of heat at a thermal head has been worsened in such a thermal printer for finer and faster printing resulting in a reduction in printing quality, minute control has been carried out on the temperature rise in the thermal head due to accumulation of heat making the thickness of the glazed layer 2 as small as approximately 30 μm and by correcting the period of energization of the heat resistors 3 by an electrical means utilizing a heat history correcting LSI.

However, when finer and faster printing is performed, it is difficult to prevent the reduction in printing quality due to the accumulation of heat at a thermal head only with such a technique. There is a need for a technique which provides a drastic solution to such a problem of heat accumulation.

Further, it has been thought that the accumulation of heat at a thermal head has been caused only by the glazed layer 2 of low heat conductivity. However, it was revealed that the insulating substrate 1 also constituted a major part of the cause of the accumulation of heat in the case of high speed printing wherein the energizing period of the heating resistors 3 is short as described above.

In addition, when energization is controlled with a very small pulse width such that the driving cycle of the heating resistors 3 will be 300 μs or shorter, predetermined printing energy must be obtained in order to achieve desired printing quality by raising the peak temperature of the heating resistors 3 of the thermal head. For example, if ambient temperature is as low as 5° C. during printing, great energy must be applied to the thermal head to allow printing. This, along with the effect of the accumulation of heat, can raise the peak temperature of the heating resistors 3 to approximately 800° C. which is higher than the temperature the glazed layer 2 can endure which is approximately 700° C. If such a situation occurs, the glazed layer 2 may be thermally deformed or melted, disabling proper printing. Thus, the prior art thermal heads have a problem that they can not be used as printhead for thermal printers to perform finer and faster printing.

SUMMARY OF THE INVENTION

The present invention has been conceived in order to solve the above-described problem and it is an object of the present invention to provide a thermal head of high heat resisting characteristics and good thermal response which allows printing with high quality at a high speed while satisfying the need for finer printing and a method for manufacturing the same.

Another object of the present invention is to provide a thermal printer wherein a heat accumulating layer is formed on a substrate and a layer of heating resistors and an electrode layer connected to the heating resistors are formed, the heat accumulating layer being formed of a compound including silicon, at least one kind of element selected among from transition metals, and oxygen.

Still another object of the present invention is to provide a method for manufacturing a thermal printer wherein a heat accumulating layer is formed on a substrate and a layer of heating resistors and an electrode layer connected to the heating resistors are formed, comprising formation of the heat accumulating layer by performing reactive sputtering in an oxygen atmosphere using a sputtering target mainly composed of silicon and at least one kind of element selected among from transition metals.

With a thermal head according to the present invention having the configuration as described above, it is possible to reduce the effect of the accumulation of heat even during high speed printing wherein the energizing period of the heating resistors is short by using a substrate made of, for example, silicon having high thermal conductivity which provides the substrate with sufficient radiation. In addition, since the heat accumulating layer is formed of a compound including silicon, at least one kind of element selected among from transition metals, and oxygen, its melting point will rise to 1000° C. or higher resulting in sufficient heat resistance.

Such a combination of the substrate and the heat accumulating layer will significantly improve the balance between the accumulation and radiation of heat of the thermal head, thereby allowing printing to be easily performed with high quality at a high speed even when the thermal head is adapted for finer printing.

DETAILED DESCRIPTION OF THE PREFERRED EMBODIMENT

An embodiment of the present invention will now be described with reference to the drawings.

Figure 1:
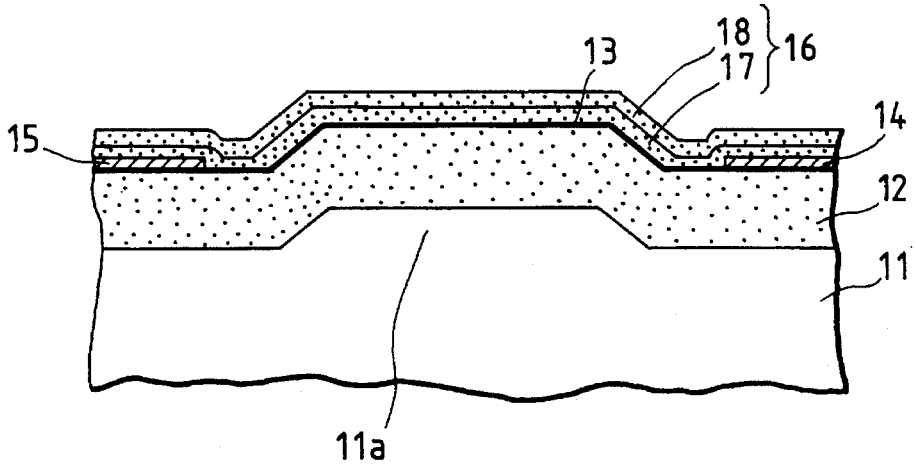
FIG. 1 is a structural sectional view of a thermal head according to an embodiment of the present invention.

FIG. 1 shows an embodiment of a thermal head according to the present invention and FIGS. 2(*a*), 2(*b*), 2(*c*), 2(*d*) and 2(*e*) are illustrations showing an embodiment of a method for manufacturing the same.

As shown in FIG. 1, the thermal head of the present embodiment wherein a projection portion 11*a* having a trapezoidal section is formed through etching or grinding on a part of the surface of a substrate 11 made of a material having high thermal conductivity such as silicon, aluminum nitride and metals. On the surface of the substrate 11 including the projection portion 11*a*, a heat accumulating layer 12 having a thickness of approximately 15 to 35 μm is formed as a heat insulating layer, which is made of a compound including silicon (hereinafter referred to as Si), at least one selected among from transition metals such as tantalum (hereinafter referred to as Ta), tungsten (hereinafter referred to as W) and molybdenum (hereinafter referred to as Mo) and oxygen. Heating resistors 13 made of $Ta_2N$, Ta-$SiO_2$ or the like are formed on the upper surface of the projection portion 11*a* on the heat accumulating layer 12. On one side of each of the heating resistors 13, a common electrode 14 connected with the heating resistor 13 is formed, and an individual electrode 15 is formed on the other side of the heating resistor 13. On the surfaces of the heating resistors 13, common electrodes 14 and individual electrodes 15, a protective layer 16 having a thickness of approximately 5 to 10 μm for protecting the heating resistors 3, common electrodes 14 and individual electrodes 15 is formed so that it covers the entire surfaces except terminal portions of the electrodes 14 and 15. The protective layer is constituted by an oxidation resistant layer 17 made of $SiO_2$ or the like having a thickness of approximately 2 μm for protecting each of the heating resistors 13 against deterioration due to oxidation and an abrasion resistant layer 18 made of $Ta_2O_5$ or the like having a thickness of approximately 3 to 8 μm laminated on the upper surface of the oxidation resistant layer 17 for protecting the heating resistors 13 and electrodes 14 and 15 against abrasion caused by contact with an ink ribbon or the like.

Steps for manufacturing the thermal head according to the present invention will now be described with reference to FIG. 2.

First, as shown in FIG. 2(*a*), a projection portion 11*a* having a trapezoidal section is formed through etching or grinding on a part of the surface of a substrate 11 made of a material having high thermal conductivity such as silicon (Si), aluminum nitride (AlN) and metals.

Thereafter, on the surface of the substrate 11 including the projection portion 11*a*, a heat accumulating layer 12 acting as a heat insulating layer and having a thickness of approximately 15 to 35 μm is formed, which is made of a compound including Si, at least one selected among from transition metals such as Ta, W, and Mo, and oxygen.

The heat accumulating layer 12 is formed by performing sputtering in a mixed gas atmosphere composed of Argon (Ar) and Oxygen ($O_2$) using, for example, a Si-Ta alloy target composed of 65 to 80 mol % Si and 15 to 35 mol % Ta or an alloy target composed of 65 to 80 mol % Si, 15 to 35 mol % Ta and 0 to 20 mol % other transition metal such as tungsten (W).

The film formation is carried out with the pressure of the sputtering gas within the range from 0.8 to 1.6 Pa and the flow rate of the $O_2$ gas set at a value such that the sputtering rate (film forming speed) will substantially be the maximum. The heat accumulating layer 12 thus formed is a black oxide having columnar properties and exhibits low thermal diffusivity and good thermal insulation.

Figure 3:
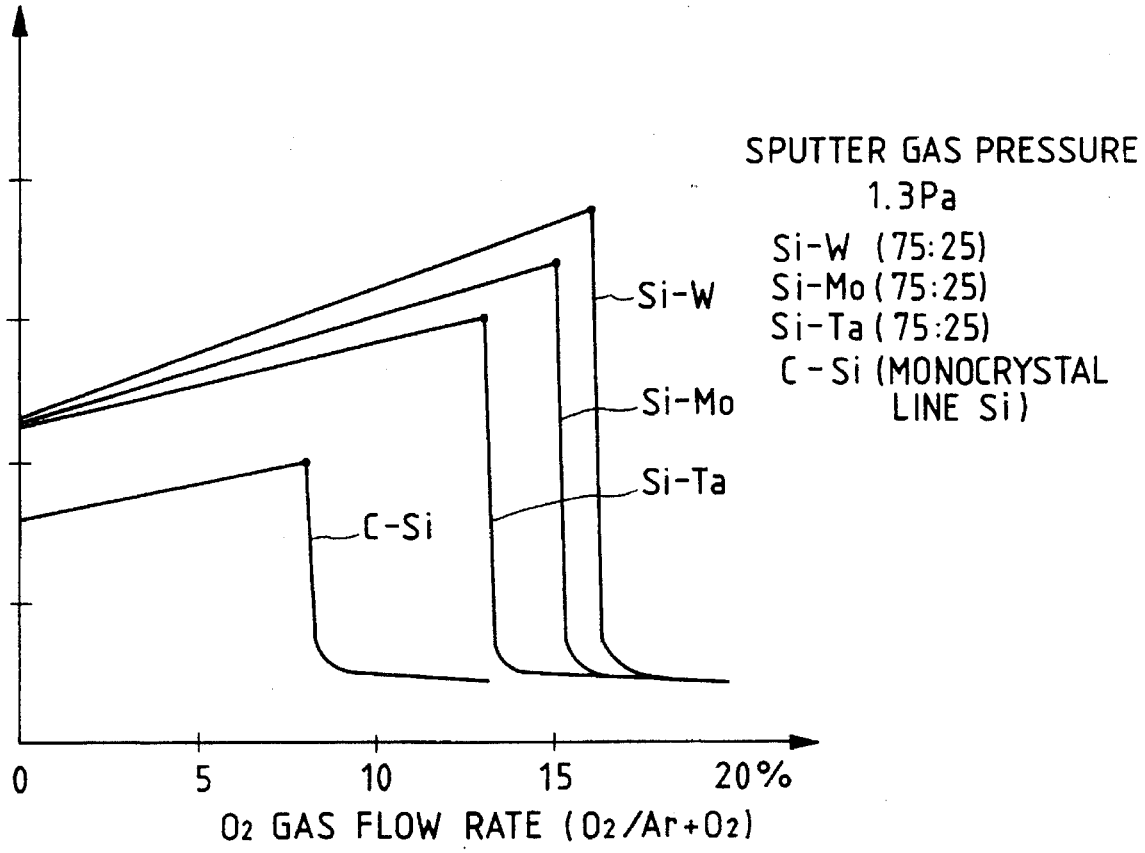
FIG. 3 is a graph showing the relationship between the flow rate of oxygen gas and the film forming speed during reactive sputtering in a manufacturing method according to the present invention.
Figure 2A:
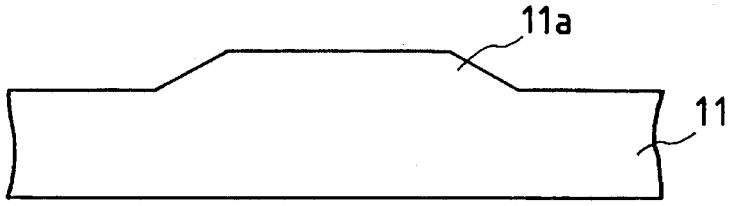
FIGS. 2(*a*), 2(*b*), 2(*c*), 2(*d*) and 2(*e*) are illustrations explaining an embodiment of a method for manufacturing a thermal head according to the present invention.
Figure 2B:
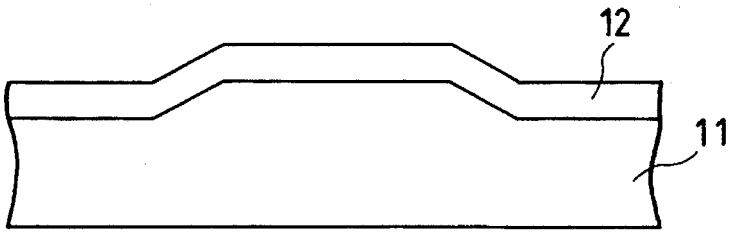
Figure 2C:
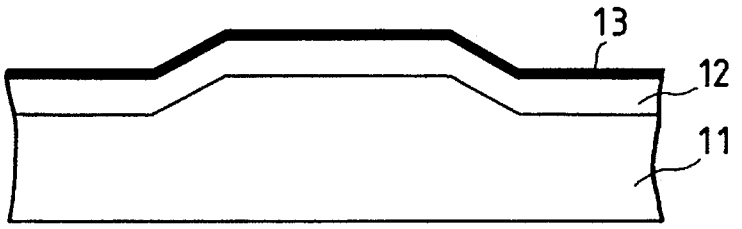
Figure 2D:
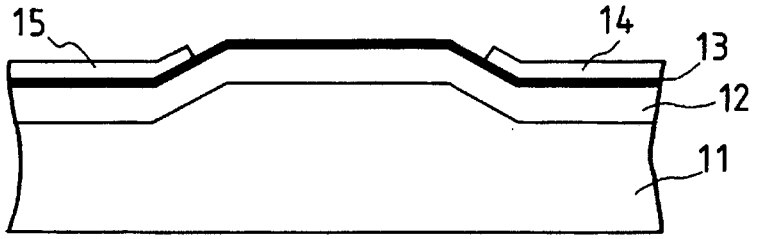
Figure 2E:
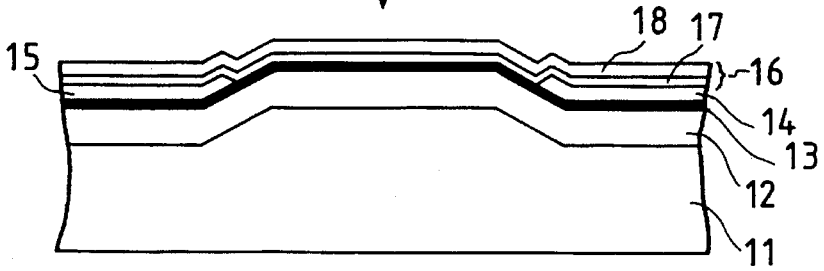

For example, when reactive sputtering is carried out in a mixed gas atmosphere composed of Ar and $O_2$ using, an alloy target mainly composed of, for example, Si and Ta, there is a point at which the sputtering rate reaches the maxim in a region wherein a black oxide is formed as shown in FIG. 3. In addition, the film forming speed will be about three times higher than that achieved with targets made of insulating materials such as $SiO_2$. It is therefore possible to form a heat accumulating layer 12 having a thickness of 15 to 35 μm at a high speed by causing two or three cathodes to discharge simultaneously during sputtering.

Since the heat accumulating layer 12 according to the present invention has some electrical conductivity, only the surface area of the heat accumulating layer 12 can be formed into an insulating oxide by increasing the flow rate of $O_2$ gas at the final stage of sputtering to prevent from the current through the heating resistors 13 from leaking.

After the formation of the heat accumulating layer 12, a vacuum annealing process is performed at about 800° C. to 1000° C. to correct any warpage of the substrate.

Since the heat accumulating layer 12 is formed to have a thickness as large as 15 to 35 μm which can normally cause large warpage on the substrate due to compressive stress of the film. According to the present invention, however, the film formed is given columnar properties by limiting the pressure of the mixed gas composed of Ar and $O_2$ within the range from 0.8 to 1.6 Pa during film formation through sputtering and the vacuum or atmospheric annealing process at about 800° C. to 1000° C. as described above makes the heat accumulating layer 12 itself denser thereby reducing the internal compressive stress in the film. This significantly reduces the warpage of the substrate. For example, warpage can be limited to 0.1 mm or less in the case of a 3 inches square substrate.

Further, the heat accumulating layer 12 itself receives a high temperature heat treatment in advance to provide it with heat history. This improves the reliability of the tightness of contact between the substrate 11 and the heat accumulating layer 12 and the heat resisting properties of the heat accumulating layer 12 itself.

Next, the heat resistor layer 13 made of $Ta_2N$, Ta-$SiO_2$ or the like is formed through sputtering or the like on the upper surface of the heat accumulating layer 12 as shown in FIG. 2(*c*). Then, in order to stabilize the thermal resistivity of the layer of the heat resistors 13, a vacuum annealing process is performed again at 800° C. to 1000° C.

Thereafter, an electrode layer made of aluminum, copper, gold or the like is formed through vapor deposition, sputtering or the like on the layer of the heat resistors 13 as shown in FIG. 2(*d*). Then, the electrode layer is patterned into a desired shape through etching to form the common electrodes 14 and the individual electrodes 15.

Thereafter, as shown in FIG. 2(*e*), the protective layer 16 having a thickness of approximately 5 to 10 μm is formed so that it covers the surfaces of the heating resistors 13, common electrodes 14 and individual electrodes 15. The protective layer 16 is formed so that it covers the entire surfaces except terminal portions (not shown) of the electrodes 14 and 15. It has a 2-layer construction wherein the oxidation resistant layer 17 made of $SiO_2$ or the like having a thickness of approximately 2 μm for protecting the heating resistors 13 against deterioration due to oxidation and the abrasion resistant layer 18 made of $Ta_2O_5$ or the like having a thickness of approximately 3 to 8 μm for protecting the heating resistors 13 and electrodes 14 and 15 against abrasion caused by contact with an ink ribbon or the like.

The operation of the present embodiment will now be described.

Assume that silicon is used for the substrate of the thermal head of the present invention. Since silicon itself has thermal conductivity of approximately $340\times10^{-3}$ cal/cm.Sec.°C. which is about eight times that of alumina (whose thermal conductivity is $40\times10^{-3}$ cal/cm.Sec.°C.) which has been conventionally used as a material for a substrate, it is possible to solve the problem of the accumulation of heat at the thermal head originating from the thermal conductivity of the substrate even in the case of high speed printing wherein the energizing period of the heating resistors 13 is short.

Since a compound including Si, at least one selected among from transition metals such as Ta, W, and Mo, and oxygen is used as the material for the heat accumulating layer 12, the heat accumulating layer 12 has thermal conductivity of approximately $1\text{–}2\times10^{-3}$ cal/cm Sec.°C. which is about 1/200 of that of a silicon substrate and provides good heat accumulating characteristics. Further, the coefficient of thermal expansion is about $1.0\times10^{-6}$/°C. which is, for example, smaller than that of silicon substrate (about $2.6\times10^{-6}$/°C.). In addition, since the heat accumulating layer has hardness of HV800 Kg/mm$^2$ or less and is mainly composed of $SiO_x$ ($0<X<2$), it exhibits a high level of tightness in the contact with the substrate. Further, a columnar film is intentionally formed by increasing the pressure of the gas during sputtering and, thereafter, an annealing process at about 800° to 1000° C. is performed. As a result, the columnar film becomes denser and the internal compressive stress inside film is released. This prevents warpage of the substrate and eliminates the problem that the film suffers from peeling or cracks in operation.

If it is assumed that there is no accumulation of heat at the heating resistors 13, the thickness of the heat accumulating layer 12 preferably satisfies the relationship that T is substantially equal to t where the heating resistors 13 are energized with a pulse width t which is the same length as the energizing period and T represents the time required for the heat generated by the heating resistors 13 to reach the substrate 11 through the heat accumulating layer 12. The specific thickness of the heat accumulating layer 12 satisfying this relationship varies depending on the speed and resolution of printing. However, it has been experimentally confirmed that thickness within the range from 15 to 30 μm is sufficient for resolution on the order of 400 dpi and printing speeds from 100 to 200 cps.

Further, since the temperature the heat accumulating layer 12 can endure can be increased to 1000° C. and higher, even if the peak temperature of the heating resistors 13 is increased to about 800° C., the heat accumulating layer 12 will not be thermally deformed. It is therefore possible to perform high speed printing even in environment at a low temperature wherein the peak temperature of the heating resistors 13 can be easily increased.

Since the temperature the heat accumulating layer 12 can endure is as high as 1000° C., it is possible to perform an annealing process at 800° to 1000° C. using a vacuum annealing furnace after forming the heating resistors 13. The high temperature annealing process provides, in advance, the heating resistor 13 with heat history at temperatures higher than the peak temperature of the actual heating during printing, thereby allowing the changes in the resistance of the heating resistors 13 due to thermal changes during printing to be suppressed.

In addition to the method wherein the flow rate of $O_2$ gas during sputtering is increased as described above, the treatment for providing the surface area of the heat accumulating layer 12 with insulating properties may be performed by employing a method wherein only the surface area is oxidized through the high temperature annealing process at the stage of forming the heat accumulating layer 12. In this case, only the surface area of the heat accumulating layer 12 may be almost completely oxidized so that it will have insulating properties by first performing an annealing process in a non-oxygen atmosphere and by switching to an oxygen atmosphere.

In the above-described embodiment, the heat accumulating layer 12 is formed on the entire surface of the substrate 11 including the upper surface of the projection portion 11*a* of the substrate 11. However, it goes without saying that the heat accumulating layer 12 may be formed only on the upper surface of he projection portion 11*a*. The thermal head may have a construction wherein the heat accumulating layer 12 is directly formed on the surface of the substrate 11 without forming the projection portion 11.

As the material for the substrate used for the thermal head of the present invention, any material may be preferably used as long as it has high thermal conductivity. Preferable materials include silicon (Si), aluminum nitride (AlN), and metals such as iron-nickel alloys.

As the transition metals used as the materials of the heat accumulating layer according to the present invention, any one or any appropriate combination of two or more kinds selected among from Ta, Ti, Cr, Mn, Fe, Co, Ni, Cu, Y, Zr, Nb, Mo, La, Ce, Hf, and W may be used. It is especially preferable to use Ta, Mo, or W alone or to combine any of them with other transition metals. Further, a heat accumulating layer having good characteristics can be obtained by employing multi-element type compositions such as Si-Ta-W-Mo-Fe-Ni and Si—Ta-W-Mo-Ti-Zr.

Embodiment 1

A target having a diameter of 203 mm and a thickness of 6 mm was produced as a sputtering target for forming a heat accumulating layer by mixing 75 mol % Si power (mean grain size 20 μm) and 25 mol % Ta powder (means grain size 20 μm), drying it after ball-milling in ethanol for 12 hours, performing hot press molding for 2 hours at 1500° C. in an Ar atmosphere, and by grinding with diamond.

Using this target, reactive sputtering was carried out on a three inches square substrate composed of monocrystalline silicon having a projection portion of 30 μm thereon in an atmosphere of a mixed gas composed of Ar and $O_2$under a pressure of 1.3 Pa to form a 30 μm thick heat accumulating layer. Insulating properties were provided only to the surface area by increasing the flow rate of $O_2$ gas at the final stage of the sputtering.

Thereafter, a vacuum annealing process was performed for 3 hours at 900° C. to suppress warpage of the substrate to a value of 0.1 mm or less.

Thereafter, a layer of heating resistors made of $TA_2N$ was formed to have a thickness of 0.5 μm through sputtering; an electrode layer was formed by sputtering Al after a vacuum annealing process for 3 hours at 800° C.; the electrode layer was etched to form common and individual electrodes; and a 2 μm thick oxidation resistant layer made of $SiO_2$ and a 5 μm thick abrasion resistant layer made of $Ta_2O5$ were formed. A thermal head having resolution of 400 dpi was thus produced.

Figure 4:
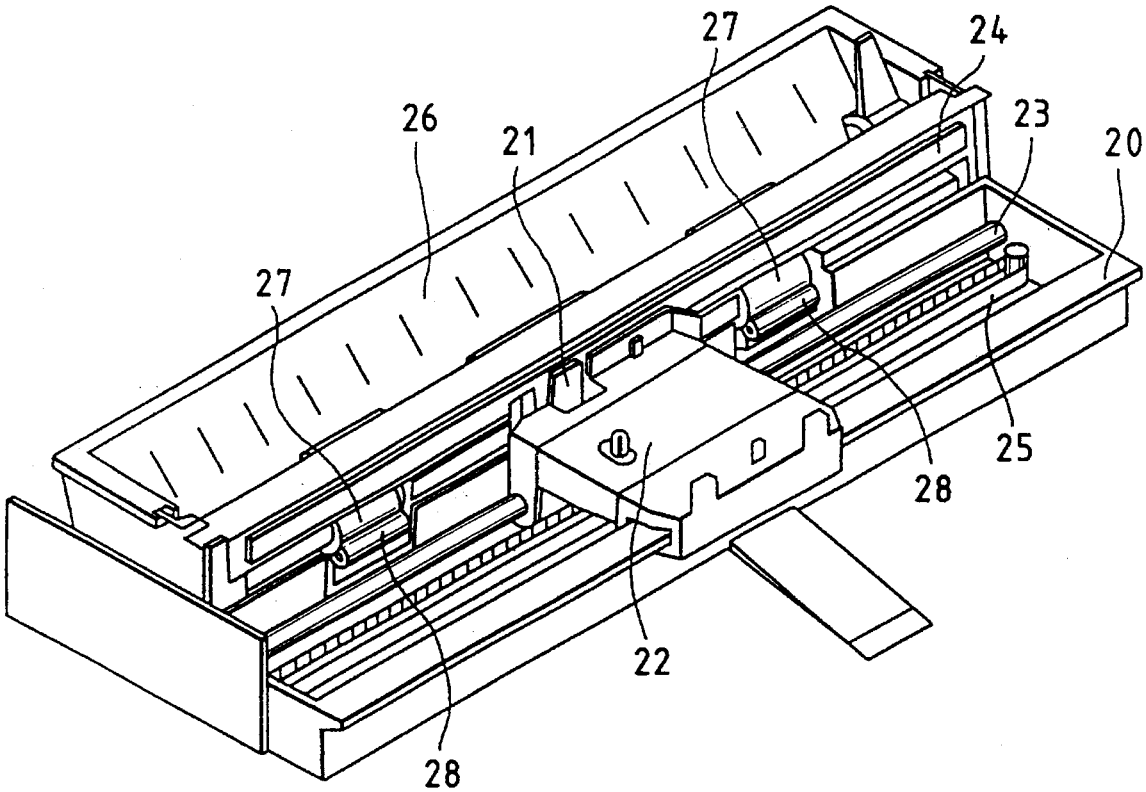
FIG. 4 is an overall perspective view showing an embodiment of a thermal printer according to the present invention.
Figure 5:
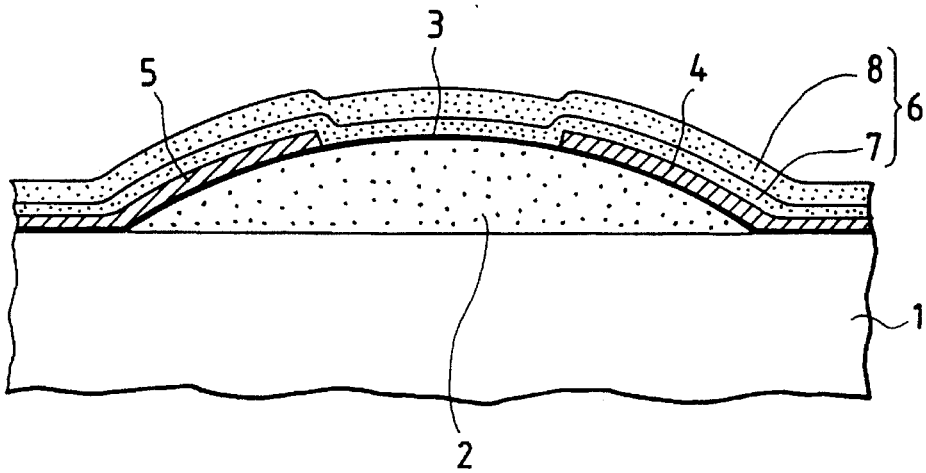
FIG. 5 PRIOR ART
FIG. 5 is a structural sectional view showing a conventional thermal head.

Actual printing test was carried out by mounting the thermal head onto a serial type thermal printer as shown in FIG. 4.

On the thermal printer shown in FIG. 4, a carriage 22 on which the thermal head 21 is mounted in the longitudinal direction of a frame 20 serving as a base, is provided so that it can reciprocate along a shaft 23. A timing belt 25 is driven with the thermal head 21 pressed into contact with a platen 24 through an ink ribbon or a recording paper, causing the carriage 22 to reciprocate to perform printing as desired.

The recording paper is supplied from a paper guide portion 26 to the printer and is sequentially forwarded to the printing device by a paper feed roller 27 and a smaller roller 28.

The actual printing at a printing speed of 100 cps using the thermal printer having the configuration as described above resulted in printing of very high quality without smears, blurs and stains in blank spaces.

Embodiments 2 to 10

Nine types of thermal heads were constructed in the same procedure as in Embodiment 1 except that the ratio of Si powder to Ta powder used for the sputtering target for forming the heat accumulating layer was varied in steps of 5 mol % each as shown on Table 1. Evaluation was made by observing the film forming speed for the heat accumulating layer and the state of warpage of the substrate. Table 1 shows the results.

As shown on Table 1, the smaller the amount of Si included is, the faster the surface of the target is oxidized. This decreases the film forming speed. Especially, Si less than 65 mol % results in a reduction in productivity in mass production which is undesirable for practical use. As to warpage of the substrate, if Si is included in a quantity more than 85 mol %, warpage of the substrate can not be avoided. Conversely, if the amount of Si included is less than 60 mol %, tensile stress produced during the annealing process undesirably causes cracks in the heat accumulating layer.

Therefore, taking both the productivity and quality of the thermal head into consideration, the heat accumulating layer is formed using a target including Si preferably in the range from 65 to 85 mol %, and more preferably from 70 to 80 mol %.

TABLE 1

| Embodiment | Ratio (mol %) Si: Ta | Film Forming speed | Warpage after Annealing |
|---|---|---|---|
| 2 | 90:10 | Good | Warp Remains |
| 3 | 85:15 | Good | acceptable |
| 4 | 80:20 | Good | Good |
| 5 | 75:25 | Good | Good |
| 6 | 70:30 | Good | Good |
| 7 | 65:35 | Acceptable | Acceptable |
| 8 | 60:40 | No Good | Acceptable |
| 9 | 55:45 | No Good | Cracked |
| 10 | 50:50 | No Good | Cracked |

Embodiment 11

A thermal head was produced in the same procedure as in Embodiment 1 except that Ta powder was changed to W powder as the sputtering target for forming the heat accumulating layer.

This thermal head was mounted to the same serial type thermal printer as in Embodiment 1 and printing was performed at a printing speed of 100 cps. As a result, printing could be performed in very high quality without smears, blurs and stains in blank spaces.

Embodiment 12

A thermal head was produced in the same procedure as in Embodiment 1 except that Ta powder was changed to Mo powder as the sputtering target for forming the heat accumulating layer.

This thermal head was mounted to the same serial type thermal printer as in Embodiment 1 and printing was performed at a printing speed of 100 cps. As a result, printing could be performed in very high quality without smears, blurs and stains in blank spaces.

As described above, according to the thermal head and the method of manufacturing of the present invention, a material having high thermal conductivity such as silicon is used as the material for the substrate and a compound including silicon, at least one selected among from transition metals and oxygen is used as the material for the heat accumulating layer. As a result, the heat radiating characteristics of the substrate itself is significantly improved; there will be no problem od heat accumulation even during high speed printing wherein the energizing period of the heating resistors is short; balance between accumulation and radiation of heat is optimized when the thermal head is adapted for high resolution; and printing can be thus performed with high quality at a high speed.

In addition, since the film forming speed for the heat accumulating layer can be increased, productivity can be greatly improved.

What is claimed is:

1. A thermal head comprising a heat accumulating layer formed on a substrate, and a heating resistor layer and an electrode layer connected to the heating resistor layer formed on the heat accumulating layer, wherein said heat accumulating layer is formed of a compound including silicon, at least one transition metal, and oxygen.

2. The thermal head according to claim 1, wherein said transition metal is at least one selected from Ta, W, and Mo.

3. The thermal head according to claim 1, wherein the thickness of said heat accumulating layer is within the range from 15 to 35 μm.

4. The thermal head according claim 1, wherein said heat accumulating layer is black.

* * * * *